US007063477B2

(12) United States Patent
Busam et al.

(10) Patent No.: US 7,063,477 B2
(45) Date of Patent: Jun. 20, 2006

(54) VARIABLE CAPACITY BINDER

(75) Inventors: Edward P. Busam, Mason, OH (US); Thomas B. Remm, Milford, OH (US); John T. Schmidt, Jr., Amelia, OH (US); William T. Thorn, III, Middletown, OH (US)

(73) Assignee: MeadWestvaco Corporation, Stamford, CT (US)

( * ) Notice: Subject to any disclaimer, the term of this patent is extended or adjusted under 35 U.S.C. 154(b) by 176 days.

(21) Appl. No.: 10/459,803

(22) Filed: Jun. 12, 2003

(65) Prior Publication Data

US 2004/0037614 A1 Feb. 26, 2004

Related U.S. Application Data

(60) Provisional application No. 60/388,579, filed on Jun. 12, 2002.

(51) Int. Cl.
*B42F 3/00* (2006.01)

(52) U.S. Cl. ..... 402/73; 402/26; 402/70; 281/29; 281/36; 281/21.1; 281/28; 281/15.1

(58) Field of Classification Search ..... 402/26, 402/70, 73, 76; 281/29, 36
See application file for complete search history.

(56) References Cited

U.S. PATENT DOCUMENTS

| | | | | |
|---|---|---|---|---|
| 1,840,743 | A * | 1/1932 | Schade | 402/39 |
| 3,993,374 | A * | 11/1976 | Schudy et al. | 312/184 |
| 4,070,073 | A * | 1/1978 | Schudy et al. | 312/184 |
| 4,127,340 | A | 11/1978 | Almgren | |
| 5,265,967 | A | 11/1993 | Han | |
| 5,642,954 | A | 7/1997 | Hudspith | |
| 6,045,286 | A * | 4/2000 | Tung | 402/37 |
| 6,168,338 | B1 * | 1/2001 | Young | 402/26 |
| 6,328,497 | B1 * | 12/2001 | To | 402/26 |
| 6,345,924 | B1 | 2/2002 | Whaley | |
| 2005/0013654 | A1 * | 1/2005 | Cheng et al. | 402/36 |

* cited by examiner

*Primary Examiner*—Boyer Ashley
*Assistant Examiner*—Mark Henderson
(74) *Attorney, Agent, or Firm*—Thompson Hine LLP

(57) ABSTRACT

A variable capacity binder including an outer cover and a binding mechanism including a plurality of spaced rings, each ring being shaped to be received through a hole of a piece of paper to couple the paper to the binding mechanism. Each ring is non-symmetrical with respect to at least one axis and has a longitudinal axis. The binding mechanism is pivotally coupled to the cover such that the longitudinal axis of each ring can be pivoted relative to the spine.

42 Claims, 12 Drawing Sheets

VARIABLE CAPACITY BINDER

This application claims priority to provisional application Ser. No. 60/388,579 filed Jun. 12, 2002, the contents of which are hereby incorporated by reference.

The present invention is directed to a binder for storing loose leaf papers, and more particularly, to a binder having a variable capacity.

BACKGROUND

Binders are widely used by students, professionals and other users to store loose leaf papers and other items. Such binders may include a spine, and a top cover, a bottom cover, and a binding mechanism mounted to the spine. The binding mechanism may include a set of three spaced rings, with each ring being located to be received through a hole of a sheet of paper to couple the paper to the binding mechanism, and therefore to the binder.

The rings of most conventional binding mechanisms are circular, and the diameter of the rings typically determine the capacity of the binder. However, binders with relatively large rings can be relatively bulky and can take up valuable space in a backpack, locker, briefcase and the like. Furthermore, when a binder with large circular rings receives only a small number of papers, a large portion of the capacity of the binder remains unused and the space occupied by the binder thereby becomes wasted space. Conversely, when a relatively small binder having relatively small circular rings is utilized, the capacity of the binder can be quickly surpassed which may require the user to acquire another binder or folder for storing additional papers, which can be separated from the first binder.

Accordingly, there is a need for a binder which has a variable capacity for storing different amounts of papers therein.

SUMMARY

The present invention is a binder which has a variable capacity for storing varying amounts of papers, and which may have an adjustable profile to vary the thickness of the binder. In one embodiment, the invention is a variable capacity binder including an outer cover having a spine, a front panel coupled to the spine and a back panel coupled to the spine. The binder may include binding mechanism including a plurality of spaced rings, each ring being shaped to be received through a hole of a piece of paper to couple the paper to the binding mechanism. Each ring is non-symmetrical with respect to at least one axis and has a longitudinal axis. The binding mechanism is pivotally coupled to the cover such that the longitudinal axis of each ring can be pivoted relative to the spine.

In another embodiment the invention is a binder including an outer cover having a front panel and a rear panel directly or indirectly pivotally coupled together such that one of the panels is pivotable relative to the other of the panels about a hinge line. The binder further includes a binding mechanism for binding a plurality of loose leaf papers together and including a plurality of rings. Each ring includes a pair of separable prong components, wherein the prong components of each ring can be separated to place paper into and remove paper from the binding mechanism. The binding mechanism is pivotable relative to the outer cover about an axis that extends generally parallel to the hinge line.

In yet another embodiment the invention is a binder including an outer cover having a front panel and a rear panel directly or indirectly pivotally coupled together such that one of the panels is pivotable relative to the other of the panels about a hinge line. The binder further includes a binding mechanism for binding a plurality of loose leaf paper together coupled to and generally not extending through the outer cover. The binding mechanism is pivotable relative to the outer cover about an axis that extends generally parallel to the hinge line.

Other objects and advantages of the present invention will be apparent from the following description and the accompanying drawings.

DETAILED DESCRIPTION

Figure 1:
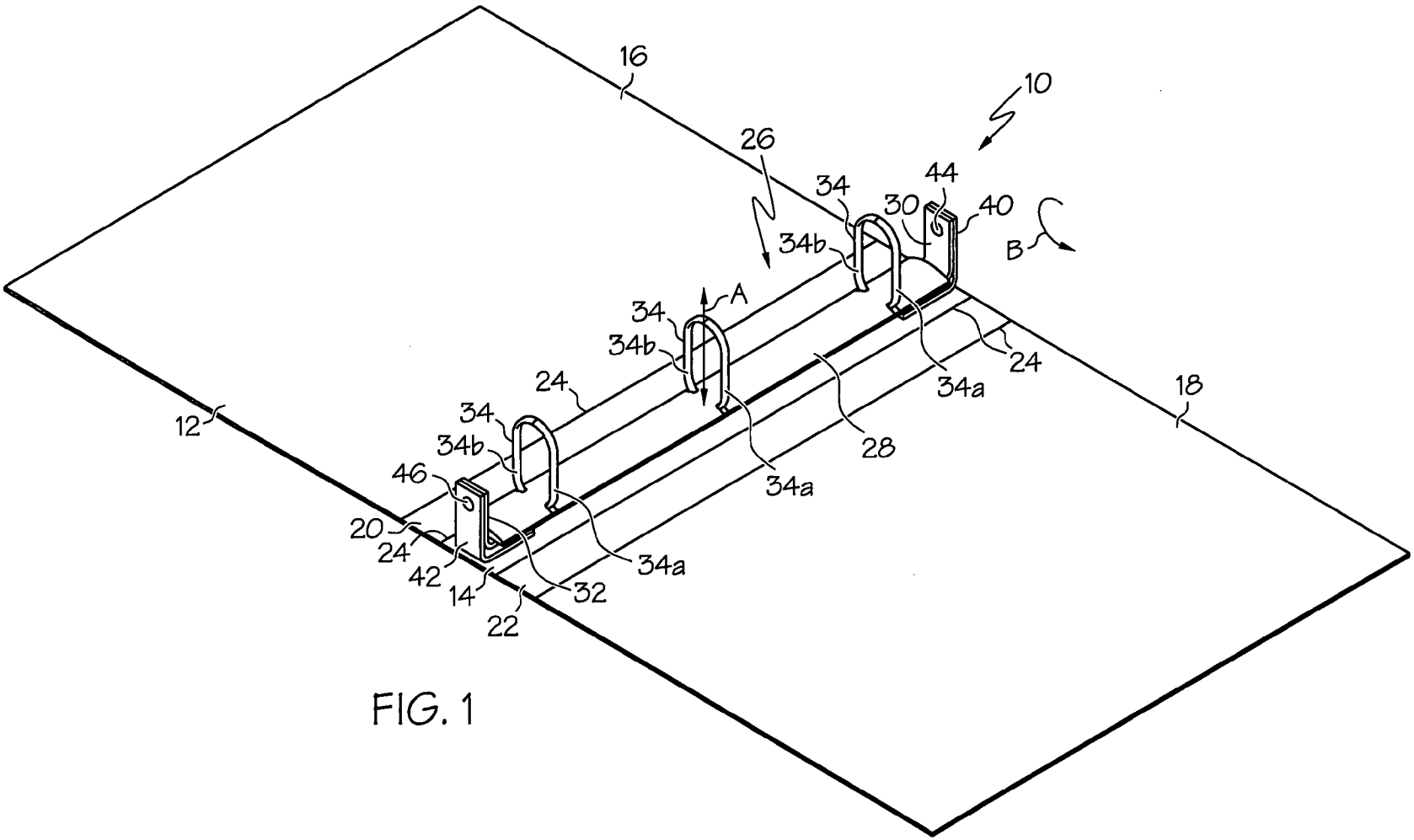
FIG. 1 is a front perspective view of one embodiment of the binder of the present invention, with the cover in its open position and the binding mechanism in its low capacity position.

As shown in FIGS. 1–12, the present invention is a variable capacity binder, generally designated 10, and may include an outer covering or outer cover 12 having a spine 14, a top cover 16 pivotally coupled to the spine 14, and a bottom cover 18 pivotally coupled to the spine 14. The outer cover 12 may include an expansion panel 20 located between the spine 14 and the top cover 16, and an expansion panel 22 located between the spine 14 and the bottom cover 18, although the expansion panels 20, 22 may be considered as part of either the spine 14 and/or adjacent cover 16, 18. The binder 10 may include a set of crease lines or hinge lines 24 so that the spine 14, covers 16, 18, and expansion panels 20, 22 are each pivotable or movable relative to any adjacent covers 16, 18, panels 20, 22 or spine 14.

The binder 10 may include a binding mechanism 26 mounted to an inner surface of the outer cover 12. The binding mechanism 26 may be coupled to the spine 14 or to the top 16 or bottom 18 cover or expansion panels 20, 22 adjacent to the spine 14. The binding mechanism 26 may include a generally longitudinally extending support strip 28 and a pair of extensions 30, 32 located at each end of the support strip 28, with each extension 30, 32 extending generally perpendicular to the length of the support strip 28. The binding mechanism 26 may also include a plurality of rings 34 coupled to and spaced along the length of the support strip 28. Each ring 34 may include a pair of separable prong components 34*a*, 34*b* and the prong components 34*a*, 34*b* of each ring 34 may be able to be separated from each other to place paper into, and remove paper 31 from, the binding mechanism 26 in a well-known manner (see FIG. 2). Thus, when the binding mechanism 26 is a three ring binding mechanism, the binding mechanism 26 may not extend through the outer cover and/or the covers 16, 18 or spine 14, in contrast to, for example, a spiral or coil binding mechanism.

The binding mechanism 26 may include a pair of actuators (not shown), with each actuator typically being located at the top or bottom of the support strip 28. Each actuator can be operated to simultaneously open (i.e., separate the prong components 34*a*, 34*b*) or close (i.e., bring the prong components 34*a*, 34*b* together) each of the rings 34 of the binding mechanism 26 in a well known manner.

The support strip 28 may be pivotally mounted to the outer cover 12. In the illustrated embodiment, a pair of brackets 40, 42 are mounted to and extend outwardly from and generally perpendicular to the spine 14. Each extension 30, 32 of the support strip 28 may be pivotally coupled to an associated bracket 40, 42 at an associated pivot point 44, 46. In this manner, the extensions 30, 32 and brackets 40, 42 pivotally couple the support strip 28 to the brackets 40, 42 and the outer cover 12 at the pivot points 44, 46. However, the support strip 28 may be pivotally coupled to the outer cover 12 in a wide variety of other manners without departing from the scope of the invention.

Each ring 34 may be eccentric, or eccentrically shaped, or non-circular, or non-symmetrical with respect to at least one axis in the plane of the ring, or have a length that is greater than a width of the ring 34. In the illustrated embodiment, each ring 34 is generally oval shaped and has a longitudinal axis A formed in a plane defined by the associated ring 34. However, each ring 34 may have a variety of other shapes beyond oval without departing from the scope of the invention, so long as, in one embodiment, each ring 34 is preferably generally non-symmetrical with respect to an axis located in a plane defined by the ring 34.

Figure 2:
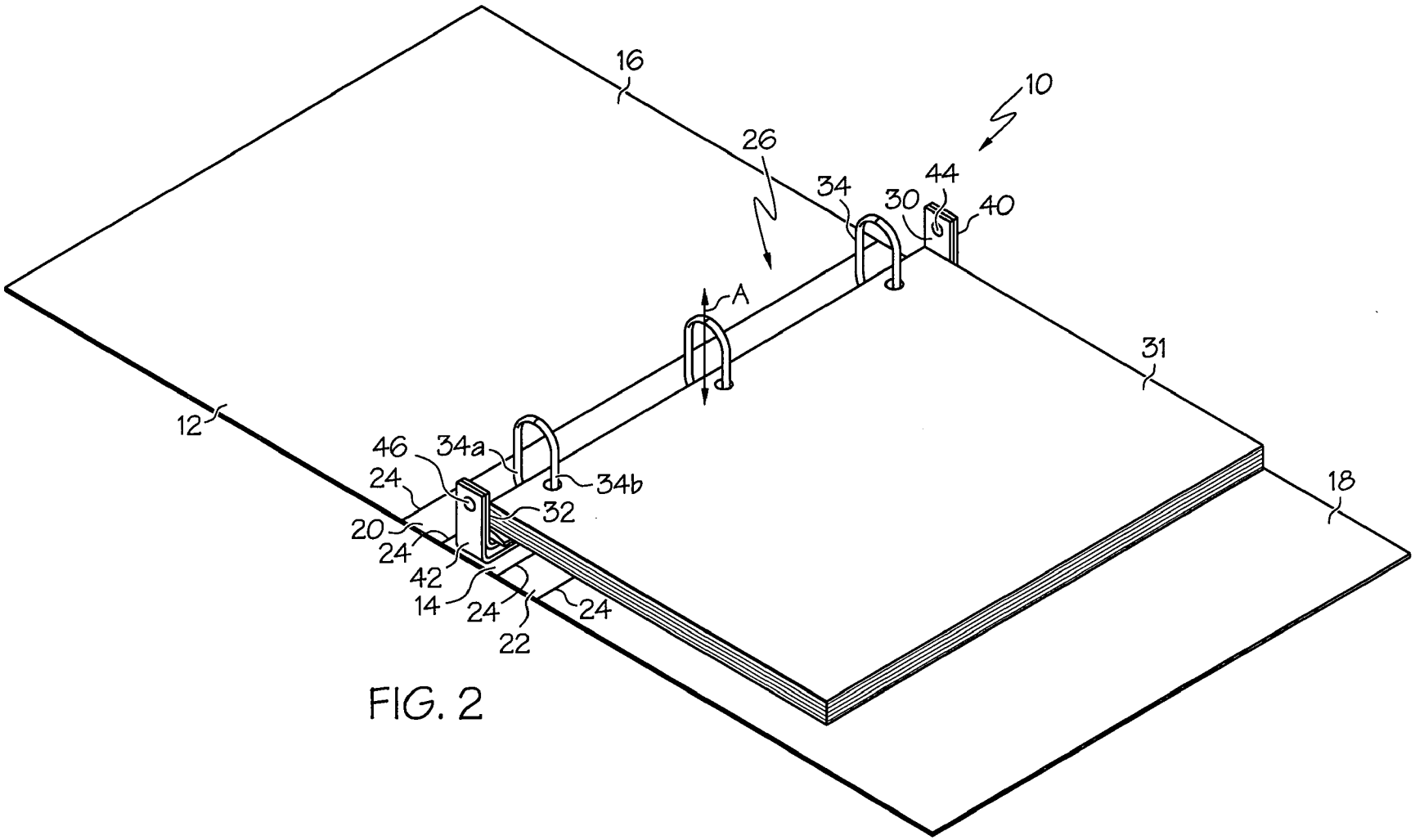
FIG. 2 is a front perspective view of the binder of FIG. 1, with a set of papers received therein.
Figure 3:
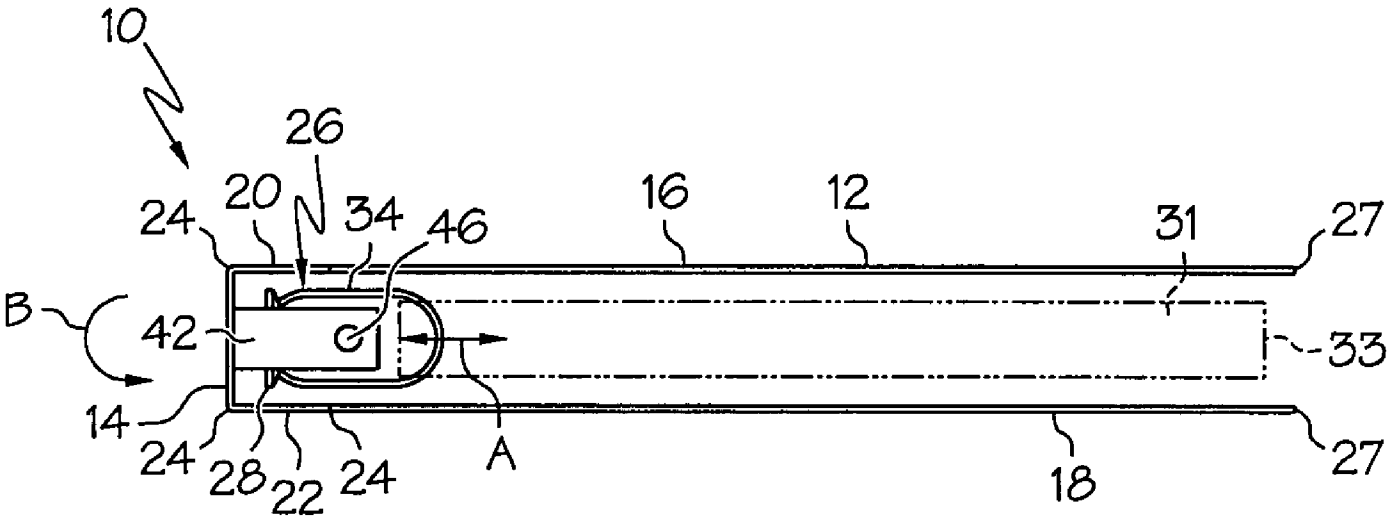
FIG. 3 is a side view of the binder of FIG. 1, with the cover in its closed position.

The binding mechanism 26 may be able to be pivoted relative to the outer cover 12 to change the thickness of, and the capacity of, the binder 10. For example, as shown in FIGS. 1–3, the binding mechanism 26 and binder 10 are in a low capacity position. When the binding mechanism 26 is in its low capacity position and the outer cover 12 is in its open position, as shown in FIGS. 1 and 2, the longitudinal axis A of each ring 34 extends generally perpendicular to the plane of the top 16 and bottom 18 covers and to the plane of the spine 14. As shown in FIG. 3, when the outer cover 12 is in its closed position, the axis A of each ring 34 is generally parallel to the planes of the top 16 and bottom 18 covers and generally perpendicular to the plane of the spine 14. In this position, the "short side" of each ring 34 is located to receive the papers 31 thereon. Thus, when the binder 10 is in its low capacity position, the binder 10 has a relatively slim profile.

The binding mechanism 26 can be pivoted to a high capacity position when it is desired to receive a relatively large number of papers 31 in the binder 10. In order to move the binder 10 to its high capacity position, the binding mechanism 26 is pivoted about the pivot points 40, 42 in the direction of arrow B such that when the outer cover 12 is in its open position the longitudinal axis A of each ring 34 is generally perpendicular to the top 16 and bottom 18 covers, and generally parallel to the spine 14 (see FIGS. 4 and 5). The spine 14 is moved to a position wherein the spine 14 is generally perpendicular to the top 16 and bottom 18 covers. Thus the binding mechanism 26 is pivotable about an axis that extends through the pivot points 44, 46 and is generally parallel to the support strip 28 and/or hinge lines 24 and/or spine 22, or extends generally perpendicular to a plane defined by one of the rings 34.

Figure 4:
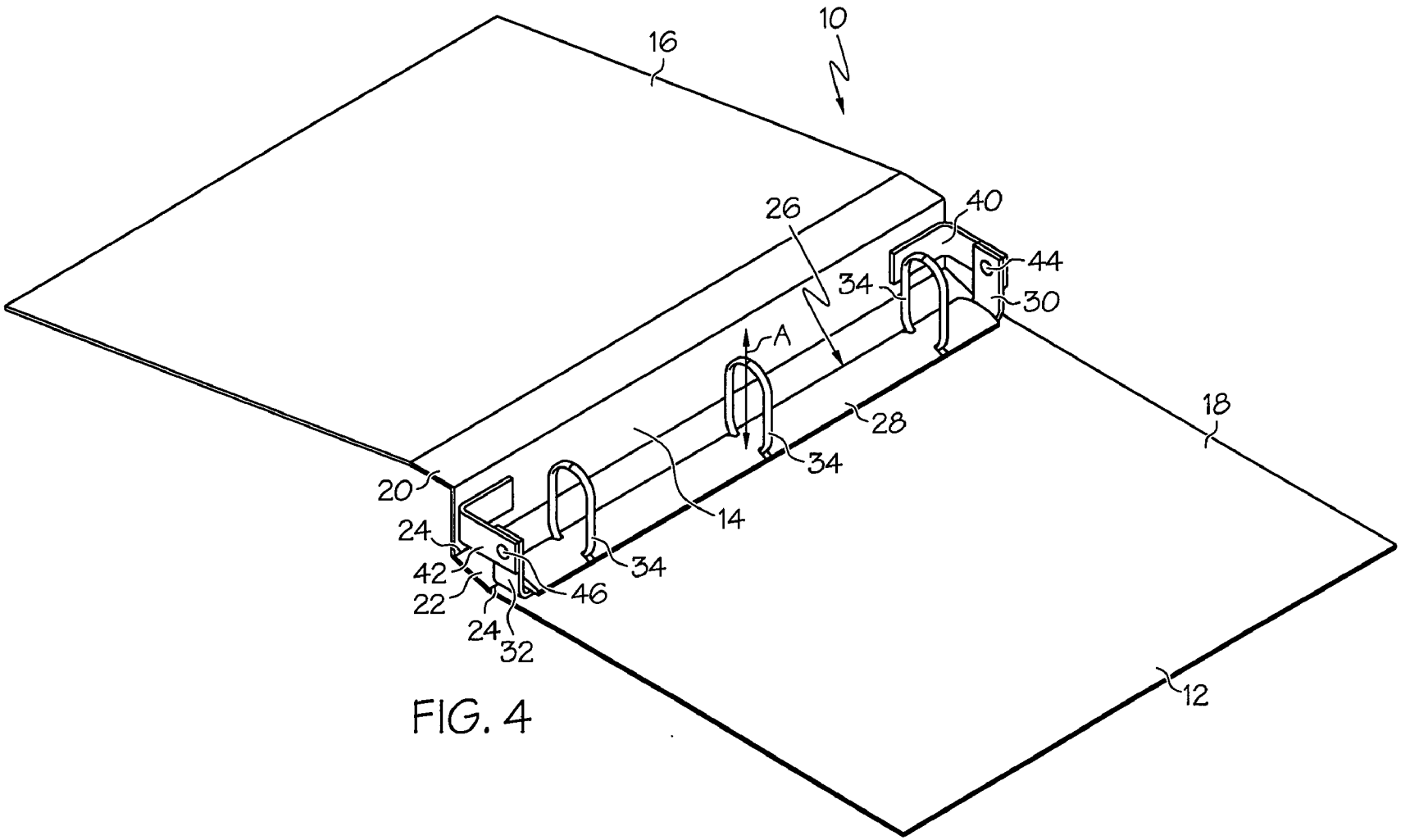
FIG. 4 is a front perspective view of the binder of FIG. 1, with the binding mechanism in its high capacity position.
Figure 5:
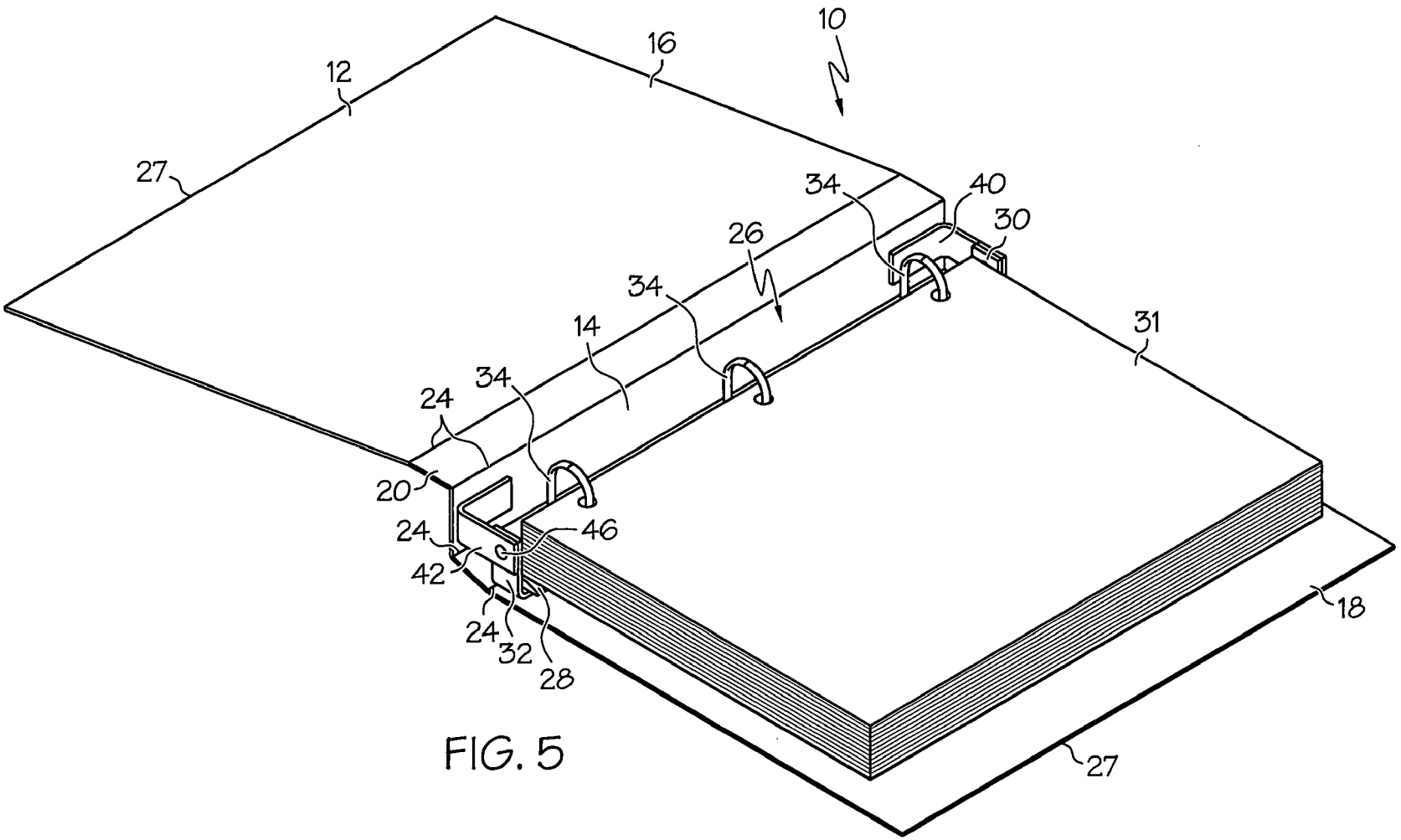
FIG. 5 is a front perspective view of the binder of FIG. 4, with a set of papers received therein.
Figure 6:
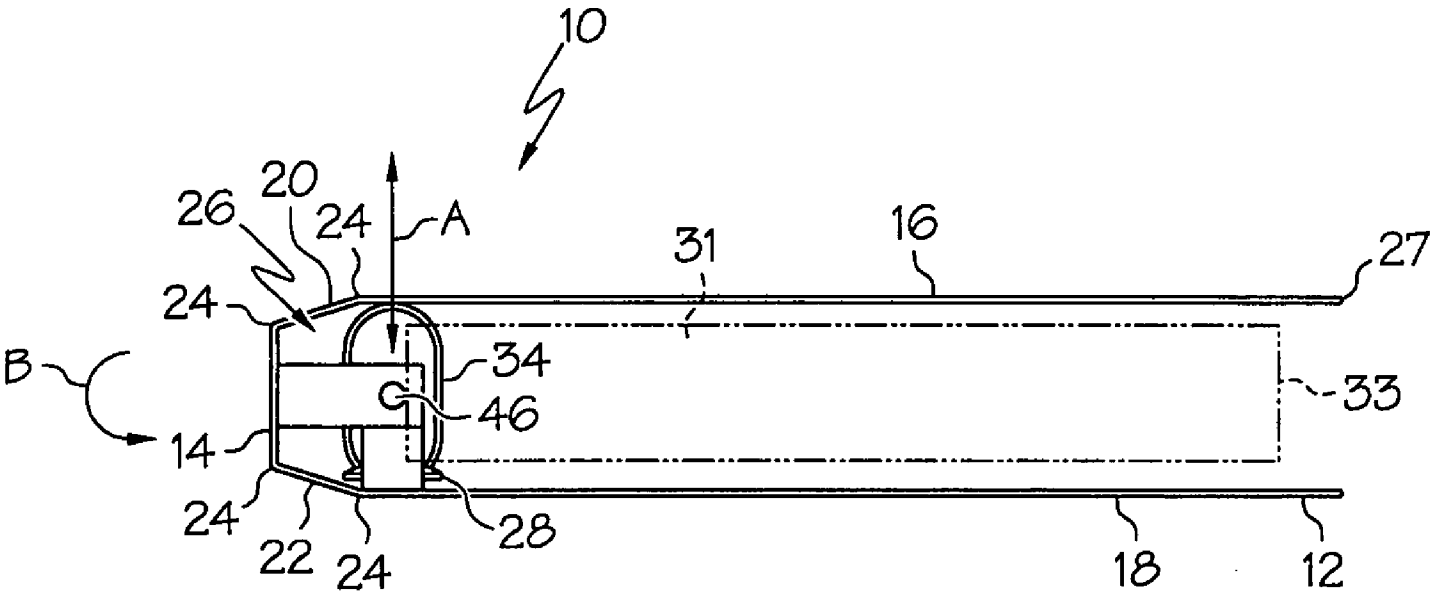
FIG. 6 is a side view of the binder of FIG. 4, with the cover in its closed position.
Figure 7:
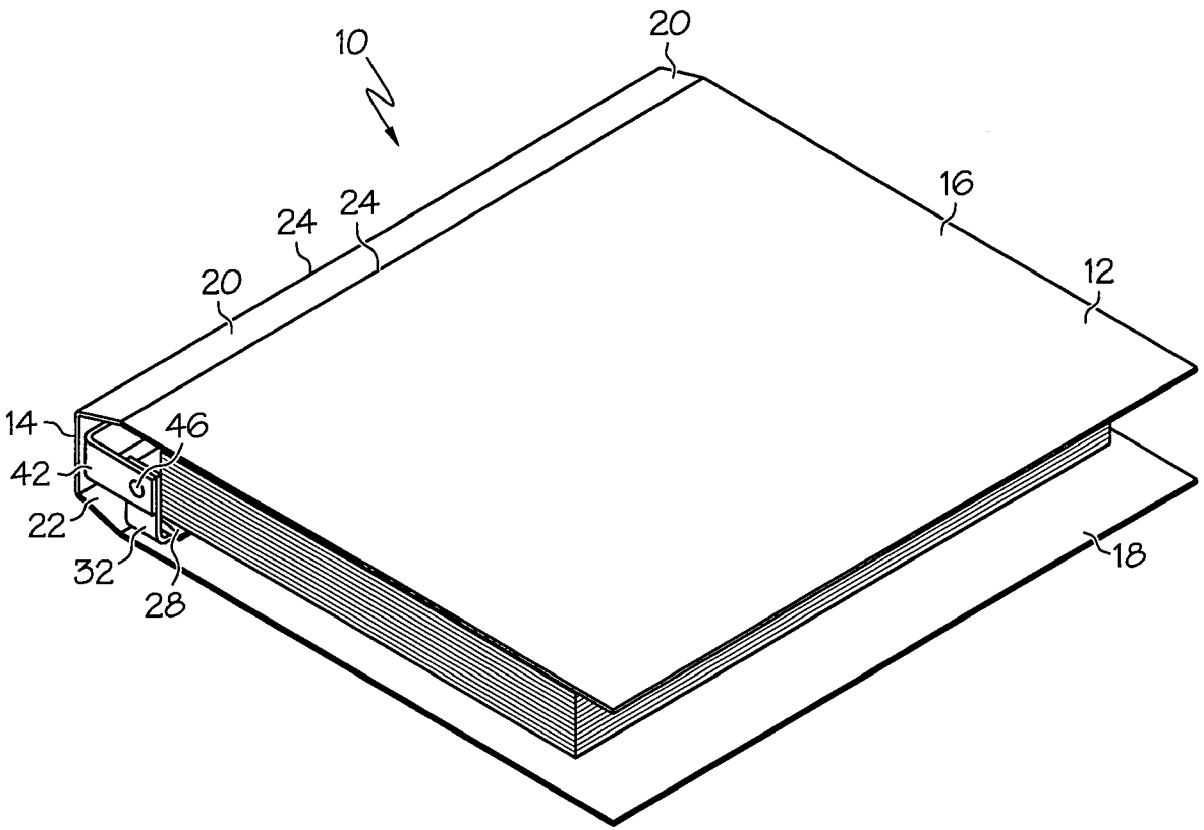
FIG. 7 is a front perspective view of the binder of FIG. 6.

In the position shown in FIGS. 4 and 5, papers 31 may be received along the "long side" of the rings 34 such that a relatively large number of papers 31 can be received in the binding mechanism 26. As shown in FIGS. 6 and 7, the expansion panels 20, 22 enable the outer cover 12 to flex outwardly slightly to accommodate the extra thickness of the rings 34 in the high-capacity position. Of course, when a lesser capacity is needed, the support strip 28 can be pivoted in a direction opposite to arrow B to return the binder to the low capacity position which presents a slimmer profile.

Figure 9:
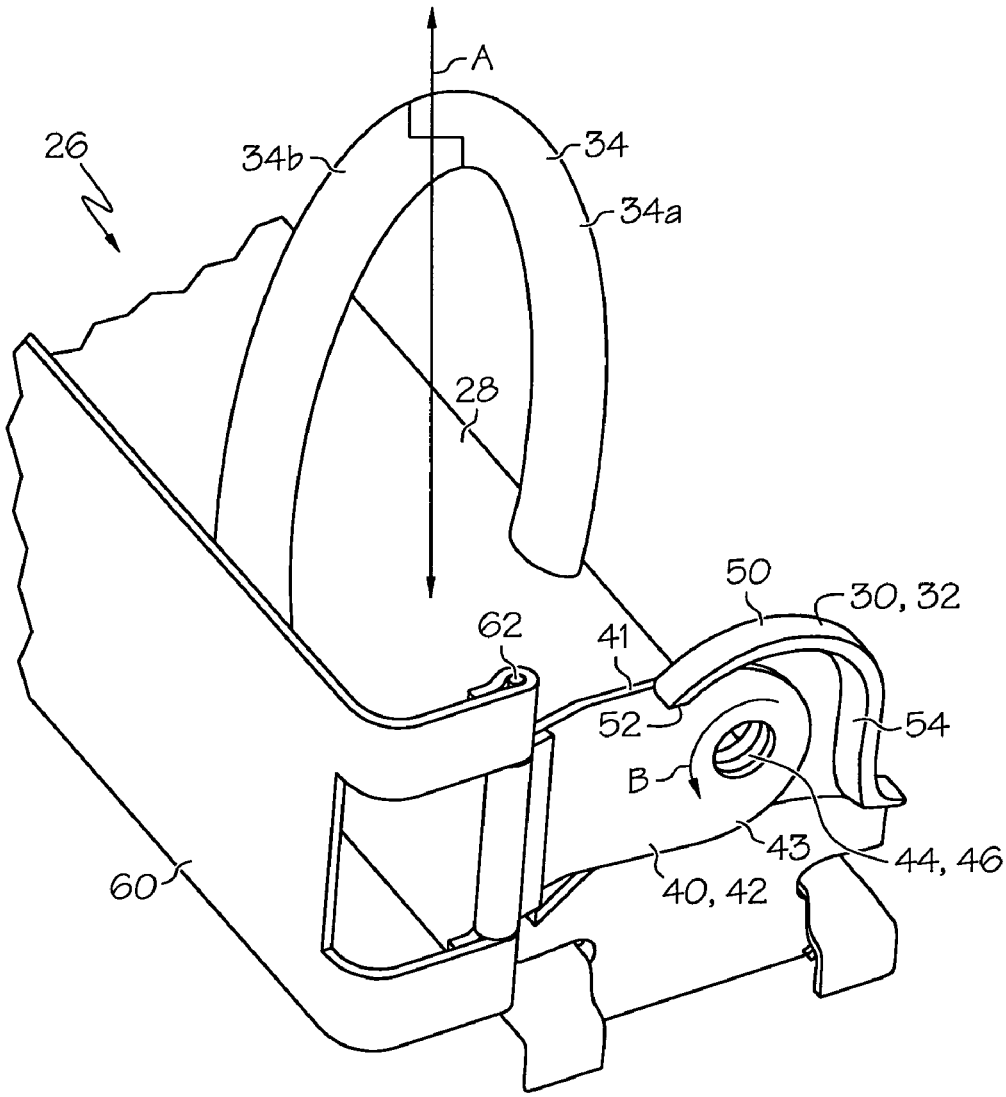
FIG. 9 is a detailed perspective view of one embodiment of the binding mechanism of the present invention in its high capacity position.
Figure 10:
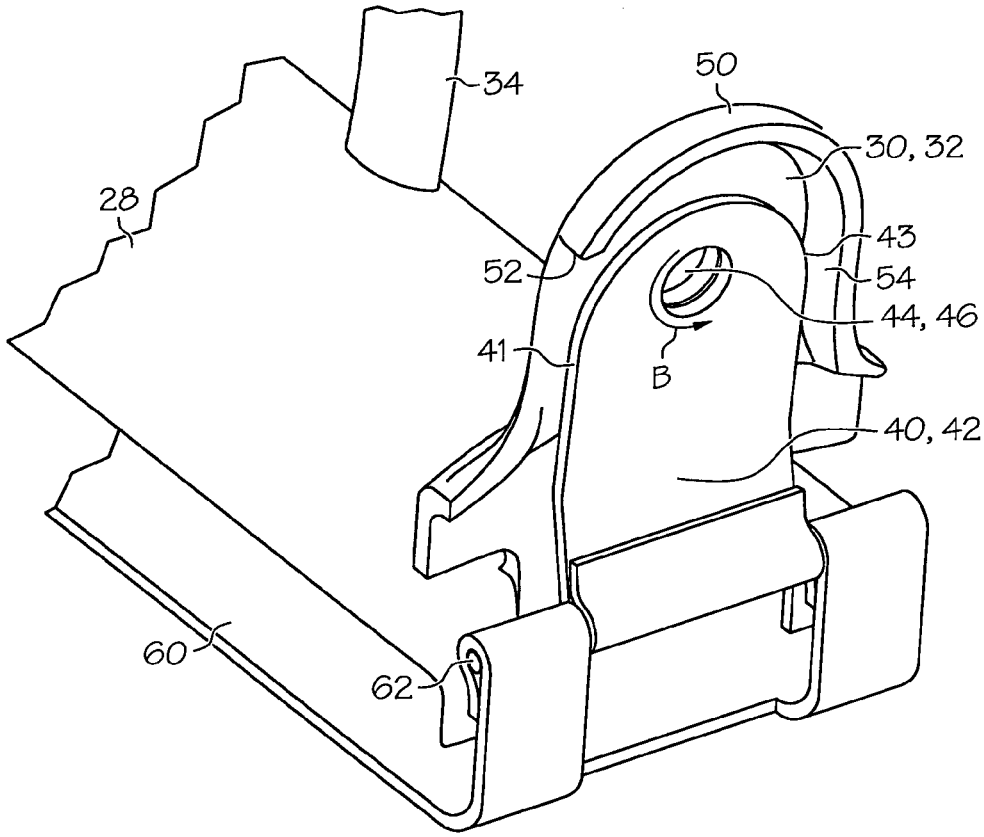
FIG. 10 is a front perspective view of the binding mechanism of FIG. 9, with the binding mechanism shown in its low capacity position.
Figure 11:
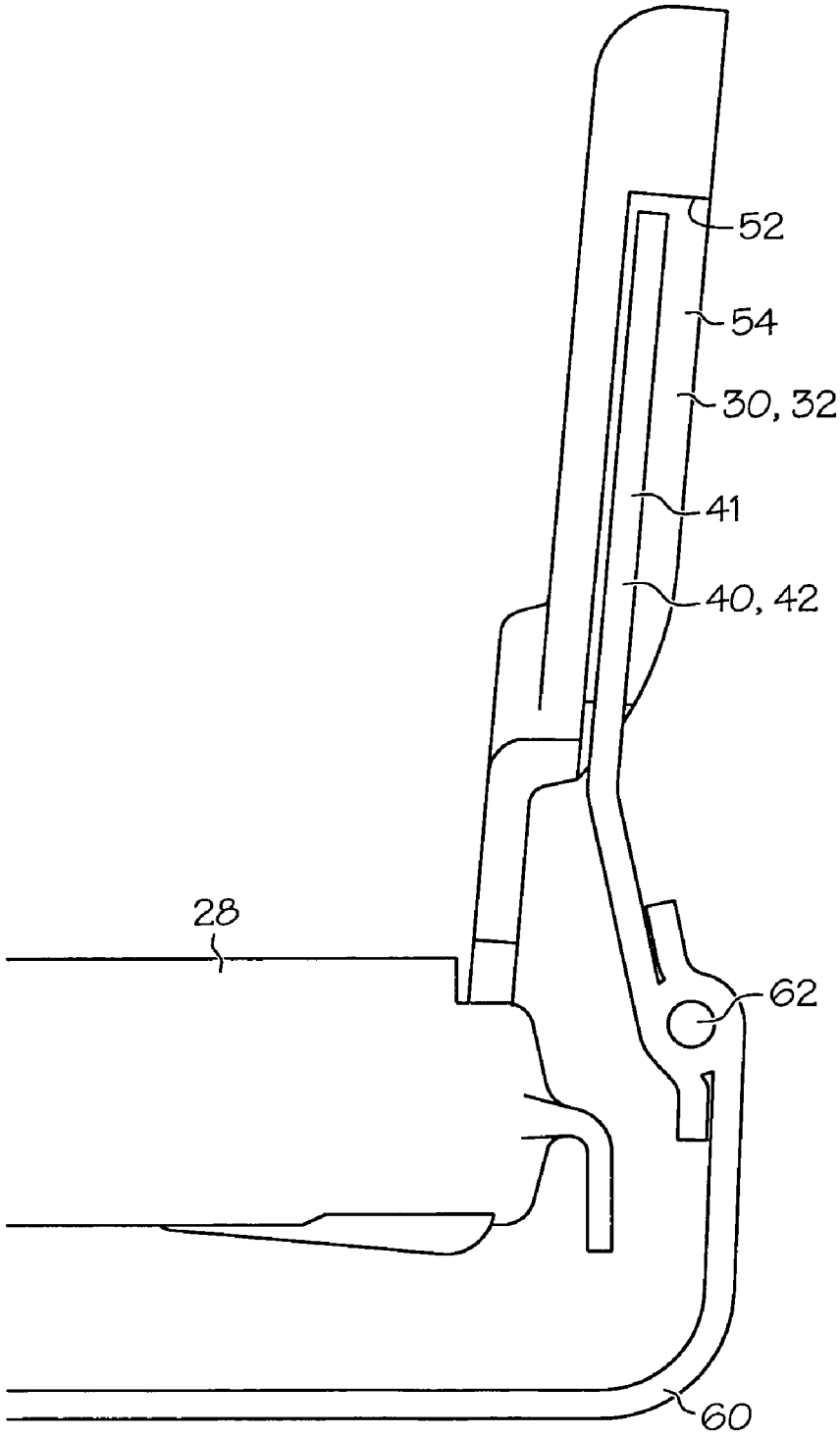
FIG. 11 is a side view of the binding mechanism of FIG. 10.

As shown in FIGS. 9 and 10, each extension 30, 32 may include a hood 50 located thereon, with each hood 50 having a pair of stop surfaces 52, 54. The brackets 40, 42 of the support strip 28 may thus engage the stop surfaces 52 when the binding mechanism 26 is in its high capacity position (FIG. 9), and the brackets 40, 42 engage the stop surface 54 when the binding mechanism 26 is in its low capacity position (FIG. 10). In this manner, the hood 50 and stop surfaces 52, 54 can limit the pivoting motion of the support strip 28 to a range of 90 degrees, and block over-rotation of the support strip 28. Of course, each bracket 40, 42 can also be viewed as having a pair of stop surfaces 41, 43 that engage the hood 50 to prevent over-rotation of the support strip 28. In the embodiment shown in FIGS. 9 and 10, each bracket 40, 42 is coupled to a support member 60 by a pin member 62 extending through an opening defined by crimped ends of the support member 60. The support member 60 thus may lie against and be coupled to the spine 14.

Figure 8:
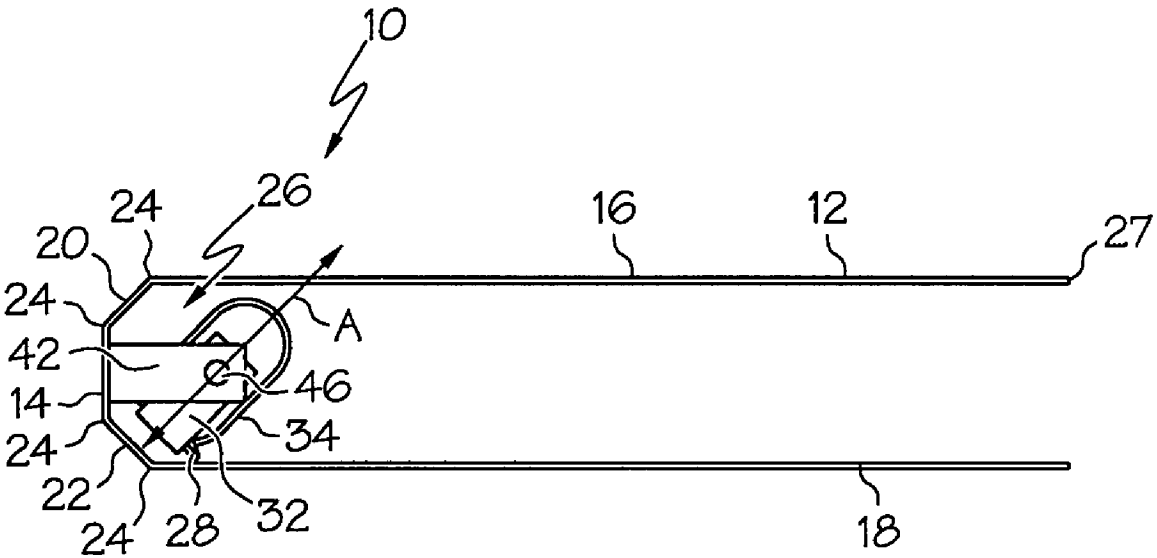
FIG. 8 is a side view of the binder of FIG. 1, with the cover in its closed position and the binding mechanism in its medium capacity position.

The binding mechanism 26 may also be pivotable to a medium capacity position, as shown in FIG. 8. In this position, the longitudinal axis A of the rings 34 forms an angle of about 45 degrees with both the spine 14 and the top 16 and bottom 18 covers. In this position, each expansion panel 20, 22 forms about a 45 degree angle with the spine 14 and the associated top 16 or bottom cover 18, and the support strip 28 is located adjacent to, and may be supported by, the expansion panel 22. The longitudinal axis A of each ring 34 is generally perpendicular and parallel to the plane of the expansion panels 22, respectively. Thus, the medium capacity position provides a higher capacity for storing papers than the low capacity position, but is thinner and presents a lower profile or thickness than when the binder 10 is in its high capacity position.

The width of the expansion panels 20, 22 and of the top and bottom covers 16, 18 (that is, the left-to-right dimension of the covers 16, 18 in FIG. 3) may be selected such that the outer edges 33 of any papers 31 (i.e. 8½"×11" papers) received in the binding mechanism 26, when the binding mechanism 26 is in its low capacity position, are at least slightly spaced inwardly from the outer edges 27 of the top 16 and bottom 18 covers (see FIG. 5). For example, each cover 16, 18 may have a width of between about 8½" and about 10", or about 9". In this manner, the outer cover 12 can protect any papers 31 received in the binding mechanism 26 regardless of the position of the binding mechanism 26.

The width of the expansion panels 20, 22 and covers 16, 18 may also be selected such that the width of the binder 10, when the binder 10 is in its low capacity position, is the same as the width of standard binders (for example, between about 9 and about 14 inches). This ensures that the binder 10 of the present invention does not protrude outwardly when stacked next to or used with other, conventional binders.

Figure 12:
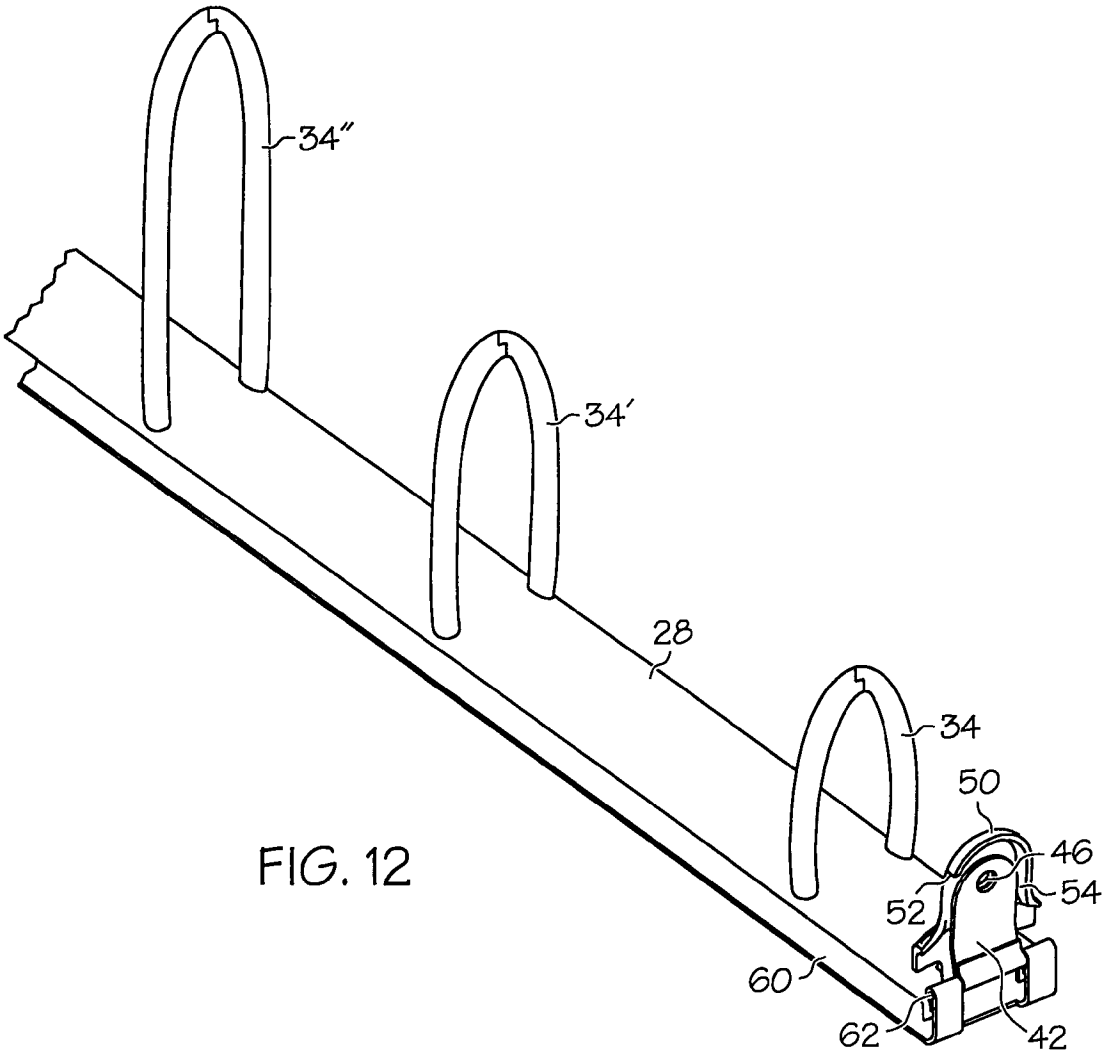
FIG. 12 is a front perspective view of a binding mechanism illustrating various ring sizes.

Of course, the size, shape and location of the rings 34 can be varied to accommodate different papers having different size and spacing of holes. The size of the rings 34 can also be varied, as can the size of the binder 10, to provide different binders having differing capacities. For example, FIG. 12 illustrates three different sizes of rings 34, 34', 34" that may be used, although differently sized rings may be necessarily be used on the same binder.

Having described the invention in detail and by reference to the preferred embodiments, it will be apparent that modifications and variations thereof are possible without departing from the scope of the invention.

What is claimed is:

1. A variable capacity binder comprising:

an outer cover having a spine, a front panel coupled to said spine and a back panel coupled to said spine;

a pair of spaced brackets that are coupled to and extend generally away from said cover; and a binding mechanism including a support strip pivotally coupled to said brackets and a plurality of spaced rings each of which is coupled to and spaced along a length of said support strip, each ring being shaped to be received through a hole of a piece of paper to couple said paper to said binding mechanism, each ring being asymmetrical with respect to at least one axis in a plane defined by said ring and having a longitudinal axis in said plane, said binding mechanism being pivotally coupled to said cover such that the longitudinal axis of each ring can be pivoted relative to said spine.

2. The binder of claim 1 wherein each ring is generally oval shaped.

3. The binder of claim 1 wherein said support strip includes a pair of extensions, each extension being located at an end of said support strip and extending generally perpendicular to a length of said support strip, and wherein each extension is pivotally coupled to one of said brackets.

4. The binder of claim 1 wherein each bracket includes a stop surface which can contact said support strip to limit a pivoting motion of said support ship.

5. The binder of claim 1 wherein said front panel is coupled to a first edge of said spine and said back panel is coupled to a second edge of said spine opposite said first edge.

6. The binder of claim 1 wherein said binding mechanism is pivotable between a low storage capacity position wherein the longitudinal axis of each ring is generally perpendicular to said spine and a high storage capacity position wherein the longitudinal axis of each ring is generally parallel to said spine.

7. The binder of claim 1 wherein said binding mechanism is pivotable to a medium storage capacity position wherein said longitudinal axis forms an angle of about 45 degrees with said spine.

8. The binder of claim 1 wherein the cover includes a pair of expansion panels, each expansion panel being located between and coupled to said spine and an associated one of said front or back panels, each expansion panel being pivotable relative to said spine and to the associated front or back panels.

9. The binder of claim 1 wherein each ring includes a pair of separable prong components, wherein said prong components of each ring can be separated to place paper into and remove paper from said binding mechanism.

10. The binder of claim 1 wherein said binding mechanism includes three rings.

11. The binder of claim 1 wherein said binding mechanism is pivotable relative to said cover about a pivot axis, and wherein said pivot axis is entirely spaced away from said cover.

12. The binder of claim 1 wherein said at least one of said front or rear panels is pivotally coupled to said spine along a hinge line and wherein said binding mechanism has a pair of longitudinal edges extending generally parallel to said hinge line, and wherein said binding mechanism is not directly pivotally coupled to said outer cover along either of said longitudinal edges.

13. The binder of claim 4 wherein said support strip is received between said brackets, and wherein each bracket includes an auxiliary stop surface which can contact said support strip to limit a pivoting motion of said support strip, and wherein said stop surface and said auxiliary stop surface of each bracket limit a range of pivoting motion of said support strip to about 90 degrees.

14. The binder of claim 11 wherein said pivot axis is spaced away from said cover by a distance at least equal to a width of one of said rings.

15. A variable capacity binder comprising:

an outer cover having a spine, a top cover coupled to said spine and a bottom cover coupled to said spine; and a binding mechanism including a support strip having a plurality of rings located thereon and spaced along a length of said support strip, each ring being shaped to be passed through a hole of a piece of paper to couple said paper to said binding mechanism, each ring being generally oval shaped and having a longitudinal axis, wherein said support strip is pivotally coupled to said spine along a pivot axis that extends generally parallel to a length of said spine such that said binding mechanism is pivotable between a low storage capacity position wherein the longitudinal axis of each ring is generally perpendicular to said spine and a high storage capacity position wherein the longitudinal axis of each ring is generally parallel to said spine.

16. The binder of claim 15 wherein said binding mechanism is pivotable relative to said cover about a pivot axis, and wherein said pivot axis is entirely spaced away from said cover.

17. The binder of claim 15 wherein said front and rear panels are directly or indirectly pivotally coupled together along a hinge line and wherein said support strip has a pair of longitudinal edges extending generally parallel to said hinge line, and wherein said support strip is not directly pivotally coupled to said outer cover along either of said longitudinal edges.

18. The binder of claim 15 wherein said front and rear panels are directly or indirectly pivotally coupled together along a hinge line, and wherein said pivot axis extends generally parallel to said hinge line.

19. The binder of claim 15 wherein said pivot axis extends through each generally oval ring.

20. The binder of claim 16 wherein said pivot axis is spaced away from said cover by a distance at least equal to a width of one of said rings.

21. A binder comprising:

an outer cover having a front panel and a rear panel directly or indirectly pivotally coupled together such that one of said panels is pivotable relative to the other of said panels about a hinge line; and a binding mechanism for binding a plurality of loose leaf papers together and including a plurality of rings each including a pair of separable prong components, wherein said prong components of each ring can be separated to place paper into and remove paper from said binding mechanism, said binding mechanism being pivotable relative to said outer cover about an axis that extends generally parallel to said hinge line, and wherein said axis is spaced away from said cover by a distance at least equal to a width of one of said rings.

22. The binder of claim 21 wherein said binding mechanism is pivotable relative to said cover independent of any pivoting motion of said front or back panels relative to said spine.

23. The binder of claim 21 wherein each ring is asymmetrical with respect to at least one axis in a plane defined by said ring and having a longitudinal axis in said plane, said binding mechanism being pivotally coupled to said cover such that the longitudinal axis of each ring can be pivoted relative to said cover.

24. The binder of claim 21 wherein said cover includes a spine located between and coupled to said front and rear panels, and wherein said binding mechanism is coupled to said spine.

25. The binder of claim 21 wherein said binding mechanism is pivotable about an axis that extends generally perpendicular to a plane defined by one of said rings.

26. The binder of claim 21 wherein said binding mechanism and said rings are coupled to a generally longitudinally extending support strip, and wherein said binding mechanism is pivotable about an axis that extend generally parallel to said longitudinally extending support strip.

27. The binder of claim 21 wherein said binding mechanism generally does not extend through said outer cover.

28. The binder of claim 21 wherein each of said rings are generally non-circular.

29. The binder of claim 21 wherein said pivot axis extends through each ring.

30. The binder of claim 24 wherein said binding mechanism is directly or indirectly coupled to said spine.

31. A binder comprising:

an outer cover having a front panel and a rear panel directly or indirectly pivotally coupled together such that one of said panels is pivotable relative to the other of said panels about a hinge line; and a binding mechanism for binding a plurality of loose leaf paper together coupled to and generally not extending through said outer cover, said binding mechanism being pivotable relative to said outer cover about an axis that is entirely spaced apart from said outer cover and extends generally parallel to said hinge line and wherein said axis is spaced away from said cover by a distance at least equal to a width of one of said rings.

32. The binder of claim 31 wherein said binding mechanism has a pair of longitudinal edges extending generally parallel to said hinge line, and wherein said binding mechanism is not directly pivotally coupled to said outer cover along either of said longitudinal edges.

33. A binder comprising:

an outer cover having a front panel and a rear panel directly or indirectly pivotally coupled together such that one of said panels is pivotable relative to the other of said panels about a hinge line; and a binding mechanism for binding a plurality of loose leaf papers together and including a plurality of rings each including a pair of separable prong components, wherein said prong components of each ring can be separated to place paper into and remove paper from said binding mechanism, said binding mechanism being pivotable relative to said outer cover about an axis that extends generally perpendicular to a plane defined by one of said rings wherein each ring is asymmetrical with respect to at least one axis in a plane defined by said ring and has a longitudinal axis in said plane, said binding mechanism being pivotally coupled to said cover such that the longitudinal axis of each ring can be pivoted relative to said cover.

34. The binder of claim 33 wherein said binding mechanism is pivotable relative to said cover about a pivot axis, and wherein said pivot axis is entirely spaced away from said cover.

35. The binder of claim 33 wherein said binding mechanism has a pair of longitudinal edges extending generally parallel to said hinge line, and wherein said binding mechanism is not directly pivotally coupled to said outer cover along either of said longitudinal edges.

36. The binder of claim 33 wherein said axis about which said binding mechanism is pivotable extends through each ring.

37. The binder of claim 34 wherein said pivot axis is spaced away from said cover by a distance at least equal to a width of one of said rings.

38. A method for adjusting the capacity of a binder comprising the steps of:

providing a binder including an outer cover and a binding mechanism including a plurality of spaced rings, each ring being shaped to be received through a hole of a piece of paper to couple said paper to said binding mechanism, each ring being non-symmetrical with respect to at least one axis in a plane defined by said ring and having a longitudinal axis; and pivoting said binding mechanism relative to said spine about a pivot axis such that the longitudinal axis of each ring is pivoted relative to said cover, wherein said pivot axis is spaced away from said cover by a distance at least ecual to a width of one of said rings.

39. The method of claim 38 further comprising the step of opening each ring and placing a sheet of paper having a set of holes into said binder such that each ring is received through one of said holes to maintain said paper in said binder.

40. The method of claim 38 wherein said cover is foldable about a hinge line and wherein said binding mechanism has a pair of longitudinal edges extending generally parallel to said hinge line, and wherein said binding mechanism is not directly pivotally coupled to said outer cover along either of said longitudinal edges.

41. The binder of claim 38 wherein said pivot axis extends through each ring.

42. A binder comprising:

an outer cover having a front panel and a rear panel directly or indirectly pivotally coupled together such that one of said panels is pivotable relative to the other of said panels about a hinge line; and a binding mechanism for binding a plurality of loose leaf papers together and including a plurality of rings each including a pair of separable prong components, wherein said prong components of each ring can be separated to place paper into and remove paper from said binding mechanism, said binding mechanism being pivotable relative to said outer cover about an axis that extends generally perpendicular to a plane defined by one of said rings, wherein each ring is asymmetrical with respect to at least one axis in a plane defined by said ring, and wherein said pivot axis extends through each ring.

* * * * *

UNITED STATES PATENT AND TRADEMARK OFFICE

CERTIFICATE OF CORRECTION

PATENT NO. : 7,063,477 B2
APPLICATION NO. : 10/459803
DATED : June 20, 2006
INVENTOR(S) : Edward P. Busam et al.

It is certified that error appears in the above-identified patent and that said Letters Patent is hereby corrected as shown below:

Col. 5, Line 44 – Change “ship” to -- strip --.

Col. 8, Line 33 – Change “eciual” to -- equal --.

Signed and Sealed this

Fifth Day of September, 2006

JON W. DUDAS
*Director of the United States Patent and Trademark Office*